United States Patent [19]

Del Bene et al.

[11] Patent Number: 4,606,202

[45] Date of Patent: Aug. 19, 1986

[54] FEEDER-STRIPPER DEVICE FOR CIRCULAR KNITTING MACHINES

[75] Inventors: Piero Del Bene, Scandicci; Ettore Negri, Florence, both of Italy

[73] Assignee: Officine Savio S.p.A., Pordenone, Italy

[21] Appl. No.: 690,838

[22] Filed: Jan. 14, 1985

Related U.S. Application Data

[63] Continuation of Ser. No. 412,372, Aug. 27, 1982, abandoned.

[30] Foreign Application Priority Data

Sep. 2, 1981 [IT] Italy ..... 83453 A/81

[51] Int. Cl.[4] ..... D04B 15/50; D04B 15/61

[52] U.S. Cl. ..... 66/134

[58] Field of Search ..... 66/14, 133, 134, 138, 66/139, 140 R

[56] References Cited

U.S. PATENT DOCUMENTS

| | | | |
|---|---|---|---|
| 2,385,081 | 9/1945 | Holmes et al. | 66/138 X |
| 2,885,874 | 5/1959 | Polach | 66/140 R |
| 2,959,040 | 11/1960 | Saunders | 66/14 |
| 3,095,719 | 7/1963 | Manger et al. | 66/133 |
| 3,605,444 | 9/1971 | Lonati | 66/139 X |
| 4,502,299 | 3/1985 | Keel et al. | 66/14 |

FOREIGN PATENT DOCUMENTS

| | | | |
|---|---|---|---|
| 825445 | 12/1951 | Fed. Rep. of Germany . | |
| 1049561 | 12/1953 | France . | |
| 1376419 | 2/1964 | France . | |
| 643154 | 7/1962 | Italy | 66/134 |
| 613596 | 11/1948 | United Kingdom . | |

*Primary Examiner*—Wm. Carter Reynolds

*Attorney, Agent, or Firm*—Stevens, Davis, Miller & Mosher

[57] ABSTRACT

Feeder-stripper device for circular knitting machines, whereby the device can be anchored substantially at a tangent to the needle cylinders and comprises a carrying structure consisting of a plurality of firm supporting surfaces to support the yarn carriers, and whereby the firm supporting surfaces are mutually sloped fan-wise in both a substantially radial direction and a substantially tangential direction in relation to the needle cylinders, whereby the yarn carriers are fitted in a relatively movable manner in relation to the firm surfaces so as to enable their own ends to follow a substantially continuous and curved path during their movement between their working position and their position of rest, and whereby each yarn carrier cooperates with a four-bar positioning and supporting linkage provided with only one degree of freedom and anchored revolvably to their respective firm supporting surface, and whereby suitable actuators rotate the respective linkage, on each of which there act bias elements cooperating with the carrying structure and set screws which cause three-dimensional adjustment of the working position of the ends of the yarn carriers.

28 Claims, 8 Drawing Figures

FEEDER-STRIPPER DEVICE FOR CIRCULAR KNITTING MACHINES

This application is a continuation of application Ser. No. 412,372, filed Aug. 27, 1982, abandoned.

This invention relates to a feeder-striper device for knitting machines.

More particularly, this invention relates to a striper device able to feed a plurality of yarns singly and alternately during the processing of knitwear products and, in particular, of men's socks.

Feeder-striper devices usually comprise a plurality of independent yarn carriers which can be operated at one and the same time so as to enable the yarns to be changed automatically, when so required, during the working cycle of a two-cylinder machine.

The yarn carriers can swing between a position of rest relatively far from the needle cylinders and a working position alongside the needles in the relative zone of feed of the yarn.

The working positions of the ends of the various yarn carriers have to coincide substantially.

A known type of feeder-striper device which is advantageously located substantially at a tangent to the needle cylinders outside the zone of feed of the yarn of the machine, works by means of axially differentiated movements of the ends of the various yarn carriers at a tangent to the cylinders, the movements being governed by especially complex cam system means which should eliminate any collisions between the yarn carriers during their respective movements.

The known devices are normally bulky and need a great deal of maintenance and constant and burdensome adjustment.

The feeder-striper device is also known which is positioned substantially radially in relation to the needle cylinders in the feed zone.

The device consists of a plurality of elements which support and guide the yarn carriers and are shaped like a C; The elements are fitted so as to swing independently of each other around a stationary upright shaft between a working position and a position of rest.

Each yarn carrier is fitted so as to slide in the direction of its own length on the respective supporting and guiding element and is associated with a respective flexible pulling means which is applied at a point off-center in relation to said stationary upright shaft.

Moreover, two spring means act in mutual cooperation and coordination, whereby the first spring means, a compression spring means, cooperates with the respective yarn carrier and the relative supporting element so as to determine first the withdrawal of the respective yarn carrier in a lengthwise direction away from the needle cylinders.

The other spring means, a torsion spring means, cooperates with the respective supporting element and the upright shaft so as to determine next the rotation of the relative supporting and guiding element towards the position of rest.

In the foregoing known device, which is described in U.S. Pat. No. 3,605,444 the two spring means are chosen in such a way that each of the flexible pulling means, being applied eccentrically in relation to the stationary shaft, overcomes first the resistance of the relative compression spring and then the resistance of the relative torsion spring, thereby determining a withdrawal of the relative yarn carrier substantially with two degrees of freedom.

This feature enables the end of the yarn carrier in question to follow a withdrawal path consisting of two distinct stretches, of which the first is straight and radial in relation to the needle cylinders, whereas the other stretch is initially curved and at a tangent to the needle cylinders.

The known device involves drawbacks. One drawback lies in the fact that the device has to be prearranged in the yarn feed zone radially in relation to the needle cylinders and thus takes up essential space in front of the feed cams and blocks access to the cams from the outside.

Another drawback is the pull which the yarn being processed exerts on the relative yarn guide.

The pull is applied in the direction of rotation of the yarn guide towards the position of rest, and this is a fact which makes the yarn guides susceptible to accidental movements and vibrations if any knots are found in the yarn being processed, the yarn guide being resisted only by a thrust spring.

A further drawback lies in the fact that the traversing movement performed by the end of the yarn carrier element starting to work is such as to slacken the tension of the yarn itself and to make the hold of the needles on the yarn precarious.

The purpose of the present invention is to embody a feeder-striper device which is not bulky and can be readily fitted to existing circular machines.

Another purpose of this invention is to obtain a strong feeder-striper device which works accurately and does not need too many adjustment.

A further purpose is to prevent any collisions between the yarn guides and to effect a quick change of yarn guides in a zone relatively far from the cylinder.

One advantage of the invention is that it comprises a fourbar linkage system having only one degree of freedom and thus obviates the need to use springs in mutual cooperation in a delicate state of equilibrium.

Another advantage is that the pull exerted by the yarn being worked is opposed positively by yarn guides having a firm seating.

A further advantage is that the yarn guide follows a curved and continuous path along which the yarn stays substantially taut, so that the hold of the needles of the yarn is ensured.

Yet another advantage is the ability to employ yarn guides having relatively thick ends, thus enabling the stripes to be made with thicker yarns.

This invention, therefore, is embodied in a feeder-striper device for two-cylinder circular machines, whereby the device can be anchored substantially at a tangent to the needle cylinders and in the neighborhood thereof and comprises a plurality of yarn carriers which can be moved independently of each other between a withdrawn position of rest and a working position near the cylinders, the device being characterized by comprising a carrying structure consisting of a plurality of firm surfaces to support the yarn carriers, whereby the firm supporting surfaces are mutually sloped fan-wise in both a substantially radial direction and a substantially tangential direction in relation to the needle cylinder in the neighborhood of the yarn feed, and whereby the yarn carriers are fitted in a relatively movable manner in relation to the firm surfaces so as to enable the ends of the yarn carriers to follow a substantially continuous and curved path during their movement between their working position and their position of rest, and whereby each yarn carrier cooperates with positioning and supporting means in the form of a linkage provided with only one degree of freedom and revolvably anchored to the respective supporting surface, and whereby suitable actuation means rotate the respective linkage means, on each of which latter there acts a bias means cooperating with the carrying structure and means which cause three-dimensional adjustment of the working position of the ends of the yarn carriers.

An essential feature of the invention is the fact that the end of each yarn carrier follows a determined continuous and curved path when moving its working position and position of rest.

Other details and features of the invention will stand out from the description given below by way of non-limitative example and with reference to the accompanying drawings, in which.

In the figures the same elements or elements performing the same functions bear the same reference numbers.

Figure 1:
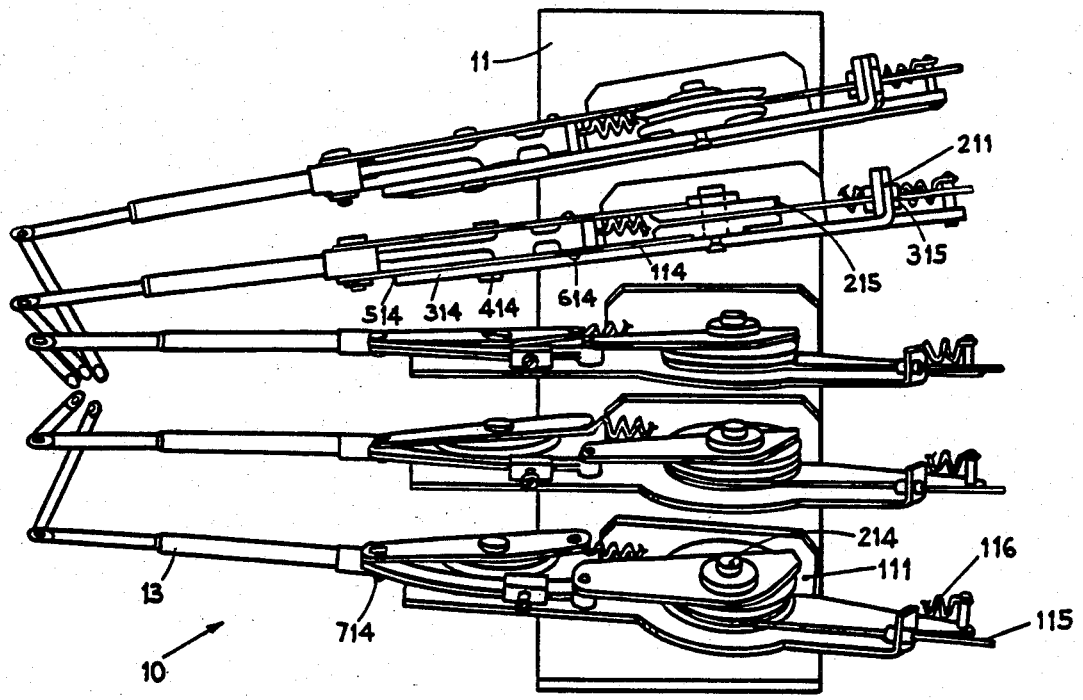
FIG. 1 shows a side view of a feeder-striper device according to the invention, with the yarn carriers substantially in a change-over position.
Figure 2:
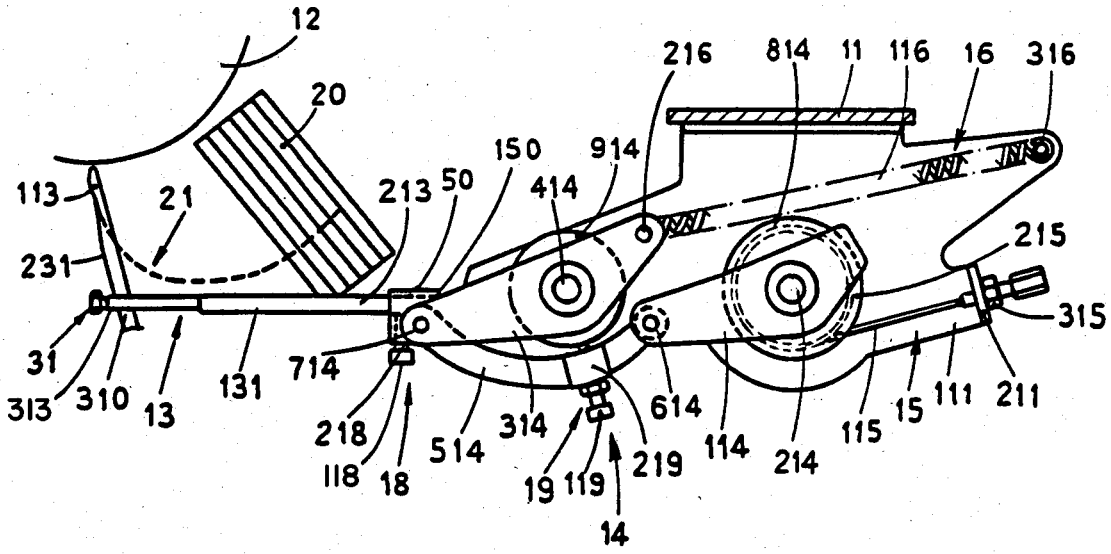
FIG. 2 shows from above a supporting surface of the device of FIG. 1 with a yarn carrier in its working position.
Figure 3:
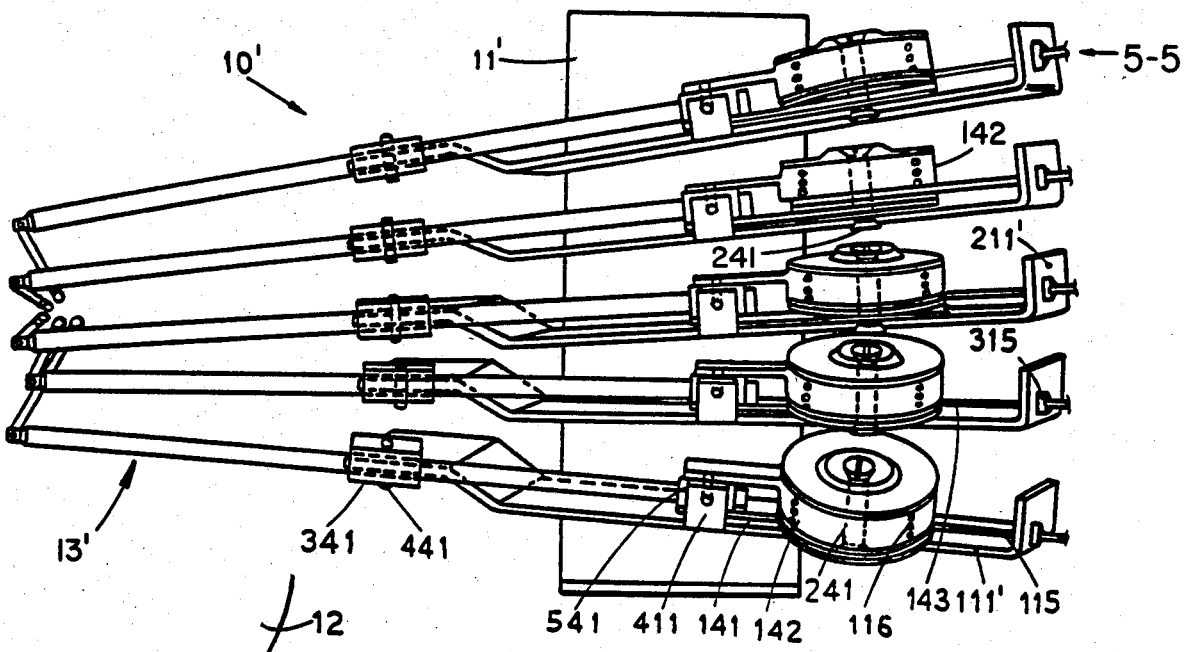
FIG. 3 shows a feeder-striper device according to a second embodiment of the invention with the yarn carriers substantially in a change-over position.
Figure 5:
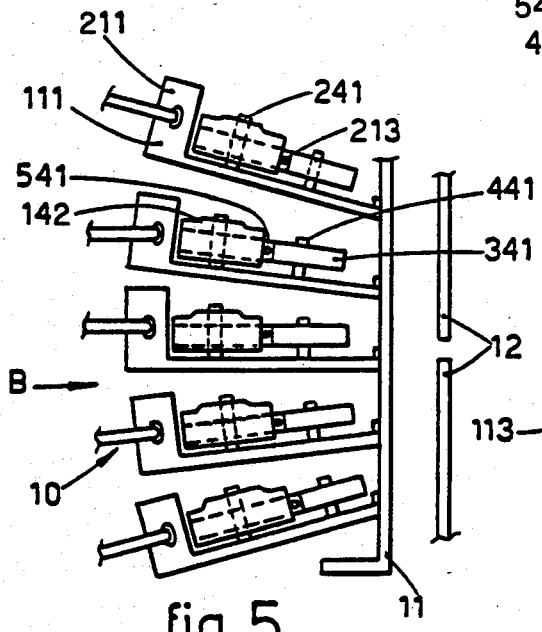
FIG. 5 shows a diagrammatic end view in the direction of the arrow 5—5 of FIG. 3 in relation to the device according to the second embodiment.

With reference to FIGS. 1 and 2 the device 10 of the invention comprises a carrying structure 11 consisting of a plurality of firm supporting surfaces 111 prearranged so as to be mutually sloped and to converge both in a tangential direction (in the description a direction substantially at a tangent to the cylinders 12 is understood to be a direction contained in or parallel to a plane substantially at a tangent to the cyliders 12 at the point of feed of the yarn and corresponding, for instance, to the direction of the arrow 5—5 in FIG. 3 and also in a radial direction (in the description a direction radial to the cylinders 12 is understood to be a direction contained in a plane substantially radial to the cylinders 12 and passing through the point of feed and corresponding, for example, to the direction of the arrow B in FIG. 5) in relation to the needle cylinders 12 shown diagrammatically.

Each of the surfaces 111 bears a yarn carrier element 13 together with linkage means 14 which position and support the yarn carrier element 13, and also bears the actuation 15 for the linkage means 14, and bias means 16 able to cooperate with the linkage means 14.

To be more specific, the yarn carrier 13 consists of two rods 131,231 connected together angularly with respect to each other and has at the free end of 231 a guiding eyelet 113 through which the yarn passes while being fed.

The yarn carrier 13 is anchored at its end 213 to the linkage means 14, which will be described hereafter.

According to a preferential embodiment of the invention the linkage means 14 as shown in FIGS. 1 and 2 consists substantially of a first drive lever 114 revolvably anchored at 214 to the supporting surface 111 and having a free end, a second lever 314, here a rocking lever, revolvably anchored at 414 to the supporting surface 111 downstream from the first lever 114 and having a free end, and a connecting lever 514 pivoting at one of its ends at 614 on the free end of the first lever 114 at its other end at 714 and on the outer end of the second lever 314.

The connecting lever 514 comprises at its end 714 a solid body forming an attachment 50 provided with a through hole 150 able to lodge to the end 213 of the yarn carrier element 13.

In this instance the two levers 114 and 314 are shaped like a fork and each of them consists of two plates shaped like each other and joined together with a core, respectively 814 and 914, having a substantially cylindrical shape.

Such a conformation enables the elements of the linkage means 14 to engage each other readily and leads advantageously to a reduction in overall weight.

Once more, according to the invention bias means 16 is a tension spring 116 secured on one end at 216 to the end of another arm of the lever 314 and on the other side to the supporting surface 111 at 316.

The bias means 16 has the task of compelling the relative linkage means 14 to take up a position corresponding to the working position of the relative yarn carrier element 13.

So as to move a yarn carrier element 13 from the feeding position to the position of rest, the actuation means 15 consists of a cable 115 wound at its end around a pulley 215 machined, in this instance, on the cylindrical core 814 of the first lever 114; The cable 115 is guided in its movement by a guide element 315 anchored to a rear edge 211 of the relative supporting surface 11 and is manipulated in a known way by suitable drive lever means or like means substantially well known in the art of circular machines.

Means 18 and 19 provide three-dimensional adjustment to regulate the feeding position of the eyelet 113 of the yarn carrier element 13 in a radial, tangential direction and in a vertical axial direction respectively in relation to the needle cylinders 12 at the point of feed of the yarn, and also to regulate the path of the eyelets 113 during its movement between the feed position and its position of rest in such a way as to make possible the cooperation of the shears group 20, which comprises, as is known, a plurality of shears of which each cooperates with its respective yarn carrier element 13.

The adjustment means 18 is pre-arranged in the attachment 50 and consists of a locking screw 118 located in a threaded hole 218 communicating transversaly with the through hole 150 into which the end 213 of the yarn carrier element 13 passes.

The adjustment means 18 also enables the the eyelets 113 to be rotated in relation to the axis of the hole 218. So as to regulate the position of the eyelet 113 in a direction tangential to the needle cylinders 12 at the point of feed of the yarn, it is enough to slacken off the locking screw 118 and to move the yarn carrier element 13 along the lengthwise axis of the hole 150, thereafter tightening up the locking screw as soon as the right position has been set. This procedure also permits the vertical position of the eyelets 113 to be adjusted, since it is possible to regulate the radial position of the eyelet in relation to the axis of the hole 218.

The adjustment means 19 regulate the radial position of the eyelet 113 in relation to the needle cylinders 12 at the point of feed of the yarn and also consist of an adjustment screw 119 cooperating with a transverse through hole 219 provided in the connecting lever 514.

The inner end of the screw 119 comes into contact with the outer surface of the cylinder core 914 of the second lever 314.

By regulating the protrusion of the inner end of the screw 119 it is possible to determine the angular position of the connecting lever 514, which is rotated partially around the point 714 and thereby modify the radial position of the eyelet 113 of the element 13, the yarn carrier element 13 being anchored to the connecting lever 514.

Such adjustments are carried out advantageously when the yarn carrier element in question is in the feeding position.

Each yarn carrier element 13 consists advantageously of a main rod 131 having its inner end 213 anchored to the linkage means 14 and its outer end 313 bearing a second rod 231 provided with the eyelet 113 at its end.

The second rod 231 can be anchored to the main rod 131 with suitable fixture means 31, whereby the second rod 231 is located at an angle to the main rod 131, so that the second rod 231 is substantially parallel to the stretch of path 21 near the feed point.

The yarn carrier element 13 can also be one L-shaped body having two tracts corresponding to the rods 131–231.

Furthermore, the path of the eyelet 113 during its movement between the feed position and the position of rest can be modified substantially.

A preferential path can be obtained by dimensioning the levers 114, 314 and 514 of the linkage means 14 as desired and in coordinated manner.

According to the invention the path 21 is substantially circular, as shown in FIG. 2.

Figure 4:
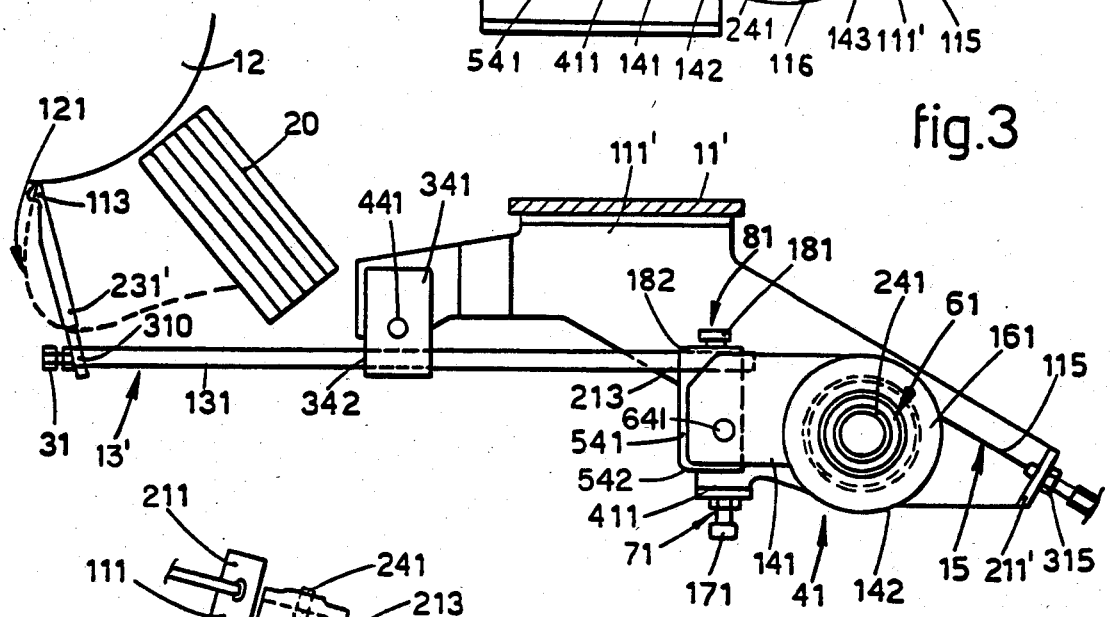
FIG. 4 shows from above a surface of the device of FIG. 3 with the yarn carrier in its working position.

The second embodiment of the device 10' of this invention, as shown in FIGS. 3 and 4, comprises a carrying structure 11' substantially like that of the basic embodiment, whereby the carrying structure 11' too has a plurality of firm supporting surfaces 111' mutually sloped in two orthogonal directions which correspond respectively to a tangential direction and a radial direction in relation to the needle cylinders 12, as in FIGS. 3 and 5.

Each surface 111' supports a yarn carrier element 13' together with linkage means 41 that position and sustain the yarn carrier element 13', and also means 15 which actuate the linkage means 41, and resistance means 61 able to cooperate with the linkage means 41.

In this embodiment too the inner end 213 of the first rod 131' opposed to the end containing the point of connection to the second rod 231' is engaged with the linkage means 41.

According to the second embodiment the linkage means 41 consist of a first drive lever 141 revolvably anchored at 241 to the supporting surface 111', a second lever 341 revolvably anchored to the surface 111' at a point 441 downstream from the point 241 (towards the point of feed of the yarn) and offset inwardly therefrom in a direction generally radial in relation to the needle cylinders 12, and a connecting lever 541 which bears at one of its ends the end 213 of the rod 131' of the yarn carrier element 13' and at the other of its ends 641 pivots on said first lever 141.

According to the second embodiment of the invention the engagement of the connecting lever 541 with the second lever 341 is indirect, in contrast with the basic embodiment, and is effected by the rod 131' of the yarn carrier element 13', whereby the rod 131' slides in a hole 342 machined in the second lever 341 and located orthogonally to the axis of rotation of the lever 341.

The first lever 141 is shaped like a fork with two plates connected together by a substantially cylindrical core 142, whereby the connecting lever 541 is pivoted between the two plates forming the first lever 141. The first lever 141 can also be made as one single piece.

The cylindrical core 142 also comprises on its outside a pulley 143 for the cable 115 actuation means 15, which are substantially like the actuation means already described with regard to the basic embodiment.

The bias means 61 of the second embodiment consists of a spiral torsion spring 161 cooperating at one end with the first lever 141 and at its other end with the supporting surface 111'.

In FIG. 4 the torsion spring 161 is wound inside the cylindrical core 142 but it could also be located on the outside thereof, and has one of its ends secured to the relative supporting surface 111' and its other end anchored to the first lever 141.

Moreover, adjustable regulating means 71 can determine the angular position of the connecting lever 541 and thereby the position of the eyelet 113 during the phase of feeding the yarn.

The regulating means 71 consist here of an adjusting screw 171 which can be screwed into an edge 411 protruding from the supporting surface 111' and corresponding with one end of the first lever 141.

The end of the adjusting screw 171 cooperates advantageously with an opposing face 542 located at the pivoted end of the connecting lever 541 in such a way as to keep the lever 541 in a direction substantially radial in relation to the needle cylinders 12 during the phase of feeding the yarn, thus enabling the rod 131' of the yarn carrier element 13 to be aligned at a tangent to the cylinders 12.

Furthermore, regulating means 81 are provided so as to adjust the position of the eyelet 113 in relation to the needle cylinders 12 and are able to determine the positions of the eyelet 113 in tangential and axial directions respectively in relation to the cylinders 12.

The regulating means 81 are at one end of the connecting lever 541, to which the inner end 213 of the rod 131' is secured, and consist here of a clamping screw 181 which can be screwed in transversely to a prearranged through hole 182 located in one end of the connecting lever 541, to which the inner end 213 of the rod 131' of the yarn carrier element 13 is secured.

The regulating means also enable the rod 131' to be rotated around its own axis, as described with regard to the regulating means 18 of the basic embodiment.

The fixture means 31 too are screw means and, as said regarding the basic embodiment, can clamp the second rod 231 in a hole located substantially crosswise near the end of the first rod 131'.

The fixture means 31 in their turn make possible a further adjustment of the position of the eyelet 113 in relation to the point of feed of the yarn along the axis of the rod 231.

It is clear that the regulating means 81 and fixture means 31 can be of a different type.

According to the second embodiment the actuation means 15 are operated so as to move the end 113 of the yarn carrier element 13' and to pull the cable 115 in a known way with known drive devices, thereby rotating the first lever 141 clockwise and overcoming the opposition of the bias means 61.

This rotation leads to the withdrawal of the rod 131' of the yard carrier element 13' and the partial rotation thereof.

The path 121 of the eyelet 113 of the yarn carrier element 13' is curved and continuous and is characterized by a movement of the feed of the yarn together with a withdrawal radially from the cylinders 12, thus ensuring in this tract that the needles keep their hold on the yarn. Thereafter the eyelet 113 retreats and move substantially towards the shears group 20 in a direction which is generally parallel to a tangent to the needle cylinders 12.

In both embodiment the rod 231' is located substantially parallel to the first tract of the movement of the eyelet 113.

In both embodiments the change-over of yarns is carried out at the same time at a point relatively far from the point of feed without any risk of collisions between the relative yarn carrier elements 13', this being due to the specific paths of the movements and to the fact that the paths are arranged in planes mutually sloped in two orthogonal directions.

It is known that the feed of an elastic yarn requires measures rather different from those used for normal yarns inasmuch as the knitting of the stitches of the elastic yarn takes place only at the beginning and end of the formation of the elastic border.

Instead, during the intermediate phase the elastic yarn is simply inserted in the weft direction with the relative yarn carrier element slightly withdrawn.

Figure 7:
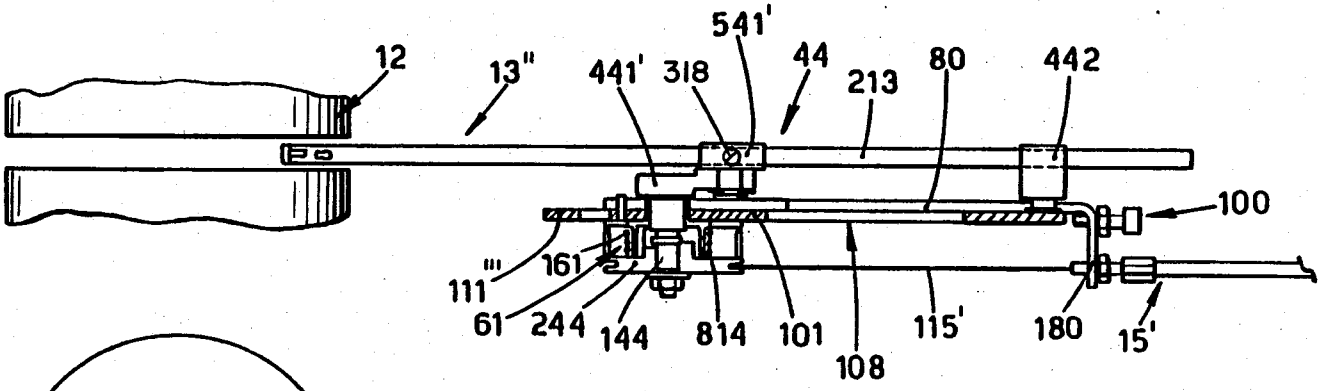
FIG. 7 shows a partial section along the surface shown in FIG. 6.
Figure 6:
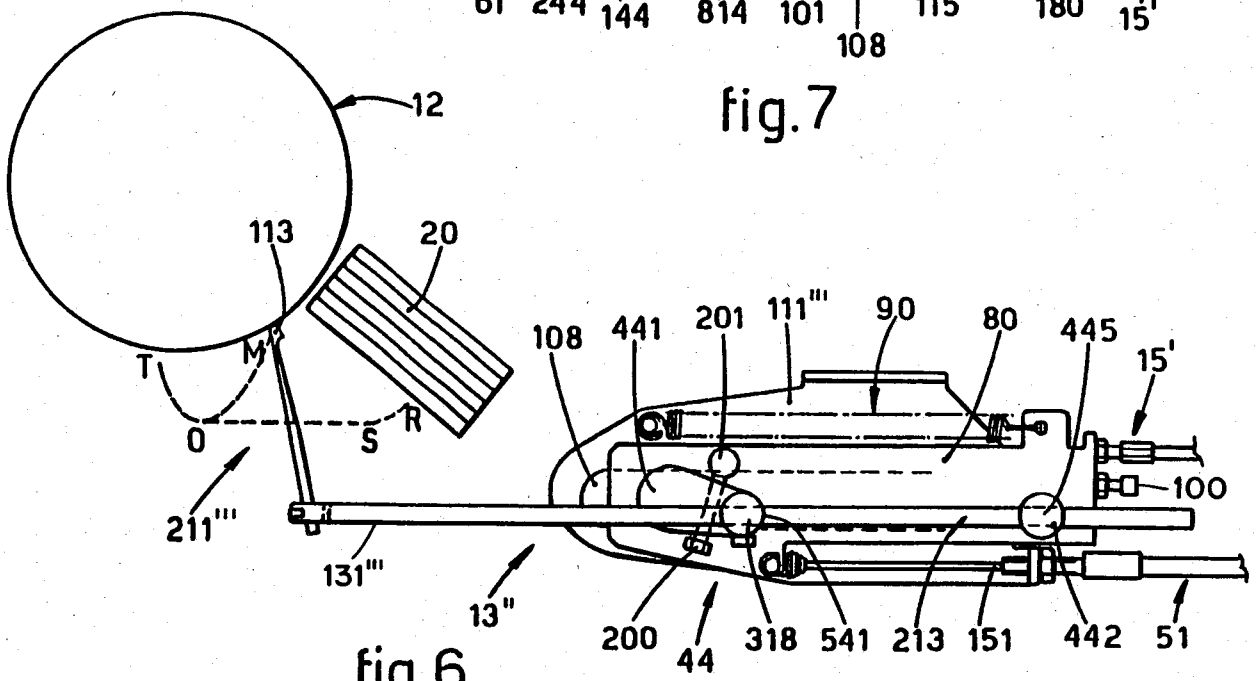
FIG. 6 shows a surface of the striper device prearranged to feed elastic yarns according to the invention.

To carry out the feed of elastic yarns, the invention comprises on one of the firm supporting surfaces 111''', preferably the lowest one, sliding means 80 which bears a yarn carrier 13'' of the type already described and the relative positioning and supporting linkage means 44 shown in FIGS. 6 and 7.

The sliding means 80 includes a plate 101 which runs within a guide slot 108 lying lengthwise in relation to the supporting surface 111'''.

The kinematic positioning and supporting means 44 have substantially the same function as that of the kinematic means 14 and 41 described earlier and they too are operated by the pulling cable 115' actuation means 15' in a manner substantially independent of the movement of the sliding means 80.

The sliding means 80 are compelled to take up a position nearer to the cylinders 12 by the action of a return means 90, which in this instance is a tension spring achored to the relative firm supporting surface 111'''.

Movement in the opposite direction is brought about through a displacement means 51, which here is a pulley cable 151 but could be of another type, such as electromagnetic actuators.

The displacement means 51 is linked to the central control system of the striper device.

The linkage means 44 comprise a drive crank 441 revolvably fitted on the sliding means 80 so that its rotational pivot 144 passes through the slot 108 and stretches beyond the lower face 814 of the firm supporting surface 111'''. Attached to the lower end of pivot 144 is pulley 244 around which passes cable 115'.

The free end of the crank 441 comprises on its upper side a revolvable disk 541' which bears the yarn carrier element 13''.

The revolvable disk 541' can be shaped like a cam or like a simple lever.

The rod 131' of the yarn carrier element 13'' is inserted in a hole located diagonally in relation to the axis of rotation of the revolvable disk 541 and is clamped by means of a locking screw 318 which can be screwed in crosswise to the rod 131'.

The rod 131' slides in a guide hole 445 located in a second guide disk 442 revolvably fitted to the outer end of the sliding means 80.

To adjust their travel, the sliding means 80 also comprise regulating means 100 which consist of an adjusting screw located in a downturned edge 180. The screw can cooperate with the edge of the relative firm supporting surface 111'.

Regulating means 200 can regulate the working position of the eyelet 113 in a direction which is radial in relation to the cylinders 12.

The means 200 consist here of an adjustable screw which can be screwed through the drive crank 441 and which cooperates with an end-face stop 201 located on the inner side of the sliding means 80.

According to the invention the path 211''' of the eyelet 113 bearing the elastic yarn is shown in FIG. 6 and consists of a straight stretch OS generated by the independent movement of the sliding means 80. Where required, a curved stretch RS-MOT due to the rotation of the linkage means 44 is superimposed on the straight stretch.

Whenever it is wished to insert an elastic yarn, which is located initially and stretched between the relative shears 20 and relative eyelet 113 in the position of rest R, the cable 115 is first pulled lightly and compels the eyelet 113 to follow the path RS. On arrival at point S, the rotation of the linkage means 44 in a clockwise direction is halted and the cable 151 is released and thereby enables the sliding means 80 to approach the cylinders 12 owing to the action of the return spring 90.

When, the eyelet 113 reaches the end of its path (point O), the linkage means 44 are operated once more by turning the crank 441 counter-clockwise.

This brings the eyelet 113 to the initial knitting point M so as to make some stitches and then to withdraw (by turning the crank 441' clockwise) through point O and to stop at point T where the elastic yarn is inserted in the weft direction.

When insertion of the elastic yarn in the weft direction has ended, the eyelet 113 is once more brought temporarily to point M so as to make some stitches before being taken to the point of rest R.

It is to be understood that rotation of the linkage means 44 and movement of the sliding means 80 take place at different times even if both of them can be performed at the same time.

The rotation of the linkage means 44 and the displacement of sliding 80 is effected by a step-motor controlled by the machine's central electronic control means.

Figure 8:
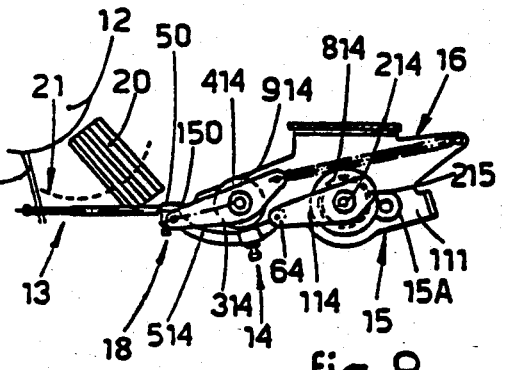
FIG. 8 shows a third embodiment of the invention.

In fact in all the described embodiments it is possible to replace the actuation means 15 and 51 by step-motor means as illustrated by way of example in FIG. 8.

FIG. 8 illustrate the feeder striper device of FIGS. 1 and 2 which includes step-motor 15A applied to the means sustaining the linkage means 14 in the vicinity of and coupled in a known manner to the pulley 215 which is integral to the driver lever 114 of the four-bar linkage means 14.

The step-motor 15A in this example replaces the cable means 115 and may be advantageously actuated by the central electronic control means of the machine.

Two preferential embodiments of the invention have been described which can also be combined, but further variants are possible for a technician in this field without departing from the scope of the invention.

We claim:

1. A feeder-striper device for circular knitting machines having needle cylinders, comprising a plurality of yarn carriers which can be moved independently of each other between a position of rest and a position at work near the feed of the yarn, a carrying structure consisting of a plurality of firm supporting surfaces to support said yarn carriers, said firm supporting surfaces being mutually sloped fan-wise in both a substantially radial direction and a substantially tangential direction in relation to the needle cylinders, said yarn carriers being fitted in a relatively movable manner in relation to said firm surfaces so as to enable ends thereof to follow a continuous substantially radial direction and therafter in a direction substantially tangential to the needle cylinders during their movement between their working position and their position of rest, a linkage positioning and supporting means for each yarn carrier having at least one pivot of rotation and revolvably anchored to its respective firm supporting surface, suitable actuation means for each yarn carrier rotating the respective linkage means, bias means for each yarn carrier acting on the linkage means and cooperating with the carrying structure and a plurality of means for each yarn carrier which cause three-dimensional adjustment of the working position of the ends of said yarn carriers.

2. The feeder-striper device as in claim 1, wherein said actuation means consist of a cable connected at its end to the respective linkage positioning and supporting means.

3. The feeder-striper device as in claim 1, wherein said actuation means consist of a step-motor acting on said linkage positioning and supporting means.

4. The feeder-striper device as in claim 1, wherein said bias means consist of spring means anchored to the respective firm supporting surface and engaged with said positioning and supporting means.

5. The feeder-striper as in claim 1, wherein said bias means consist of a tension spring anchored at one end to the respective firm supporting surface and at its other end to the respective linkage positioning and supporting means.

6. The feeder-striper device as in claim 1 or claim 2, wherein said bias means consist of a spiral spring of which one end is anchored to the respective firm supporting surface and the other end is anchored to the relative linkage positioning and supporting means, said spiral spring being prearranged around the pivot of rotation of one element of said linkage positioning and supporting means.

7. The feeder-striper device as in claim 1, wherein said linkage positioning and supporting means consist of a first drive lever revolvably anchored to the respective supporting surface, a second lever revolvably anchored to the same supporting surface downstream from said first lever, and a connecting lever pivoted at one end respectively to the free end of said first drive lever and on the other end to the free end of said second lever.

8. The feeder-striper device as in claim 7, wherein said drive-lever and said second lever are shaped fork-wise and each of said levers is provided with a cylindrical core revolvably anchored around a rotation pivot solidly fixed to the supporting surface.

9. The feeder-striper device as in claim 8, wherein said cylindrical core of the drive lever comprises a pulley able to lodge the coils of the cable of the actuation means to rotate said drive lever, the end of said cable being secured to said pulley.

10. The feeder-striper device as in claim 7, wherein said second lever comprises a second free end to which the end of the tension spring of the bias means is secured.

11. The feeder-striper device as in claim 7, wherein said connecting lever comprises its end engaged with said second lever and an attachment for the end of the yarn carrier.

12. The feeder-striper device as in claim 7, wherein said adjustment means defines a first hole at a right angle to a pivot of rotation of said second lever, said hole lodging the yarn carrier, and a second threaded hole at a right angle to said first hole and includes a locking screw screwable into said second hole and seatable against said yarn carrier.

13. The feeder-striper device as in claim 7, wherein said connecting lever comprises regulating means to regulate the working position of the eyelet of the yarn carrier radially in relation to the needle cylinders.

14. The feeder-striper device as in claim 13, wherein said regulating means define a threaded hole in said connecting lever orthogonally to and in correspondence with a pivot of rotation of said second lever and include a threaded adjusting screw screwable into said threaded hole in said connecting means to cooperate in its working position with a cylindrical surface of a core of said second lever.

15. The feeder-striper device as in claim 1, wherein said linkage positioning and supporting means consist of a drive lever revolvably anchored to the relative supporting surface, a second lever revolvably anchored to the same supporting surface at a point inwardly in relation to the point of anchorage of said drive lever and a connecting lever pivoted at one end on a free end of said drive lever and carrying at its other end the end of the yarn carrier, said second lever being provided, at a free end, with a guide hole located orthogonally in relation to the pivot of rotation of said second lever, said yarn carrier sticking in said guide hole.

16. The feeder-striper device as in claim 15, wherein said drive lever is shaped like a fork and has a cylindrical core the outside of which defines a pulley to lodge coils of a cable of the actuation means.

17. The feeder-striper device as in claim 16, wherein said cylindrical core contains a spiral torsion spring of the bias means, said spring being disposed coaxially with said core and having one of its ends secured to said first lever and its other end secured to the respective supporting surface.

18. The feeder-striper device as in claim 15, wherein said connecting lever comprises on its free end one of said means for three dimensional adjustment to regulate the working position of the eyelet of the yarn carrier in a tangential direction and an axial direction in relation to the needle cylinders, said regulating means consisting of a through hole located orthogonally in relation to the anchorage pivot of said drive lever and a locking screw screwable orthogonally to said through hole and able to lodge its end against the yarn carrier.

19. The feeder-striper device as in claim 15, including means to regulate the angular position of said connecting lever in its working position, said regulating means consisting of an adjustment screw which can be screwed into an edge protruding from the respective supporting surface so as to correspond with the free end of the drive lever and cooperating at its end with the pivoted end of said connecting lever.

20. The feeder-striper device as in claim 1, wherein said yarn carrier consists of a main rod, a second rod that bears the yarn guiding eyelet at its free end connected at an angle to said main rod.

21. The feeder-striper device as in claim 20, wherein said main rod is substantially parallel to an end tract of the path followed by the eyelet.

22. The feeder-striper device as in claim 20 or claim 21, wherein said three-dimensional adjustment means include fixture means, said two rods anchored together with said fixture means, said fixture means consisting of a through hole which passes substantially traversely within said main rod and which is able to lodge the second rod, and a locking screw that can be screwed in transversely to said through hole.

23. The feeder-striper device as in claim 1, wherein each said firm supporting surface and linkage positioning and supporting means support one said yarn carrier, said yarn carrier being pre-arranged to feed elastic yarn, said linkage positioning and supporting means being movable lengthwise in relation to said firm supporting surface.

24. The feeder-striper device as in claim 23, including a sliding means and wherein said linkage means that position and support said yarn carrier are fitted to said sliding means which can run lengthwise in relation to said firm supporting surface.

25. The feeder-striper device as in claim 24, wherein said sliding means is equipped on its lower side with a sliding guide block which cooperates with a lengthwise slot machined in the firm supporting surface.

26. The feeder-striper device as in claim 25, including a rod and a pulley and wherein each said linkage positioning and supporting means comprise a drive crank revolvably anchored to said sliding means and having a rotational pivot which protrudes through said guide slot beyond the lower face of the firm supporting surface, said pulley cooperating with the actuation means being keyed onto said pivot and the free end of the crank bearing on its upper side a revovable disk within which said rod, forming a portion of the yarn carrier element, is inserted and clamped diagonally, the outer end of said rod sliding in and guided by a hole located diagonally in a guide disk revolvably anchored upon said sliding means.

27. The feeder-striper device as in claim 26, wherein said pulley carries means to bias said pulley in a direction opposite to said actuation means.

28. The feeder-striper device as in claim 25, wherein said sliding means comprises regulating means to regulate the length of travel and return means.

* * * * *